United States Patent [19]

Taira et al.

[11] Patent Number: 4,655,183

[45] Date of Patent: Apr. 7, 1987

[54] DISTRIBUTOR-TYPE FUEL INJECTION PUMP HAVING INJECTION RATE CONTROL FUNCTION FOR INTERNAL COMBUSTION ENGINES

[75] Inventors: Shigeo Taira; Toru Ishibashi, both of Higashimatsuyama, Japan

[73] Assignee: Diesel Kiki Co., Ltd., Tokyo, Japan

[21] Appl. No.: 775,125

[22] Filed: Sep. 12, 1985

[30] Foreign Application Priority Data

Sep. 19, 1984 [JP] Japan ..... 59-140926[U]

[51] Int. Cl.[4] ..... F02M 41/12; F02M 59/08

[52] U.S. Cl. ..... 123/449; 123/503; 417/268

[58] Field of Search ..... 123/299, 300, 449, 450, 123/496, 503; 417/254, 268

[56] References Cited

U.S. PATENT DOCUMENTS 4,542,725 9/1985 Yasuhara ..... 123/299

FOREIGN PATENT DOCUMENTS 65857 4/1982 Japan .

155569 9/1984 Japan ..... 123/449

*Primary Examiner*—Tony M. Argenbright

*Attorney, Agent, or Firm*—Frishauf, Holtz, Goodman & Woodward

[57] ABSTRACT

A distributor-type fuel injection pump for an internal combustion engine wherein the plunger has first and second portions with different diameters from each other, defining first and second pump working chambers, respectively. A communication passageway is arranged for communicating the second pump working chamber with fuel delivery passageways leading to respective fuel injection valves of the engine. A drain passageway is arranged for communicating the communication passageway with a zone under a lower pressure of the pump, and is selectively closed and opened by a selector valve. An electronic control unit is responsive to operating conditions of the engine for driving the selector valve to selectively assume closed and open positions. Fuel is pressure delivered to the fuel injection valves from one or both of the first and second pump working chambers, depending upon whether the selector valve assumes the closed position or the open position. The pump is so constructed that the plunger has an increased delivery stroke, when the selector valve is controlled by the control means to assume a predetermined one of the closed position and the open position and at the same time the control sleeve assumes a predetermined position relative to the plunger.

5 Claims, 8 Drawing Figures

DISTRIBUTOR-TYPE FUEL INJECTION PUMP HAVING INJECTION RATE CONTROL FUNCTION FOR INTERNAL COMBUSTION ENGINES

BACKGROUND OF THE INVENTION

This invention relates to a distributor-type fuel injection pump for internal combustion engines, and more particularly to a fuel injection pump of this kind which has a function of varying the injection rate in response to operating conditions of the engine.

An injection rate control system for a distributor-type fuel injection pump has been proposed, which is adapted to vary the injection rate in response to operating conditions of the engine, by Japanese Provisional Patent Publication (Kokai) No. 57-65857. This injection rate control system comprises two pump working chambers defined, respectively, a portion with a larger diameter and a portion with a smaller diameter of a plunger, which makes a concurrent reciprocating and rotative motion for delivery and distribution of fuel into cylinders of the engine, and selector means for selectively causing one or both of the two pump working chambers to take part in fuel injection, to thereby vary the injection rate.

According to this injection rate control system, when the engine is operating in a high speed/high load region, the two pump working chambers are both made to operate for fuel injection, while when the engine is operating in a low speed/low load region, only one of the chambers is made to operate for fuel injection. In the latter case, as a changeover is made from the concurrent operation of the two pump working chambers to the single operation of only one of the chambers, the injection quantity is suddenly reduced by a considerable amount to cause a sudden large drop in the engine rotational speed, impairing the driveability of the engine.

SUMMARY OF THE INVENTION

It is therefore the object of the invention to prevent a sudden large reduction in the injection quantity at the time of changeover from the concurrent operation of the two pump working chambers to the single operation of one of the chambers, thereby ensuring smooth driveability of the engine at transition of the engine operation into a low speed/low load region.

The present invention provides a distributor-type fuel injection pump for an internal combustion engine having a plurality of cylinders and a plurality of fuel injection valves for injecting fuel into respective ones of the cylinders. A plunger is arranged for concurrent reciprocating and rotative motion in response to rotation of the engine to perform pressure delivery and distribution of fuel into the cylinders of the engine. The plunger has a first portion and a second portion having different diameters from each other. A first pump working chamber is defined by the first portion, and a second pump working chamber by the second portion, respectively. A plurality of fuel delivery passageways are arranged for communication with the first pump working chamber and lead to respective ones of the fuel injection valves of the engine. A communication passageway is arranged for communicating the second pump working chamber with the fuel delivery passageways. A drain passageway is arranged for communicating the communication passageway with a zone under a lower pressure of the pump. A control sleeve is displaceable relative to the plunger for determining the timing of fuel injection end. A selector valve is arranged to selectively close and open the drain passageway. Control means is responsive to operating conditions of the engine for driving the selector valve to selectively assume a closed position and an open position in which the drain passageway is closed and opened, respectively. Fuel is pressure delivered to the fuel injection valves from one or both of the first and second pump working chambers, depending upon whether the selector valve assumes the closed position or the open position. The fuel injection pump according to the invention is characterized by including means for increasing a delivery stroke to be executed by the plunger, when the control sleeve assumes a predetermined position relative to the plunger and at the same time the selector valve is controlled by the control means to assume a predetermined one of the closed position and the open position.

The above and other objects, features and advantages of the invention will be more apparent from the ensuing detailed description taken in conjunction with the accompanying drawings.

BRIEF DESCRIPTION OF THE DRAWINGS

FIG. 2 (*b*) is a similar view to FIG. 2 (*a*) but with the plunger in a different circumferential position;

FIG. 3(*b*) is a similar view to FIG. 3 (*a*) but with the plunger in a different circumferential position;

FIG. 4 (*b*) is a graph showing the relationship between the fuel pressure and the plunger rotational angle; and FIG. 4 (*c*) is a graph showing the relationship between the fuel injection quantity and the plunger rotational angle.

DETAILED DESCRIPTION

The invention will now be described in detail with reference to the drawings showing an embodiment thereof.

Figure 1:
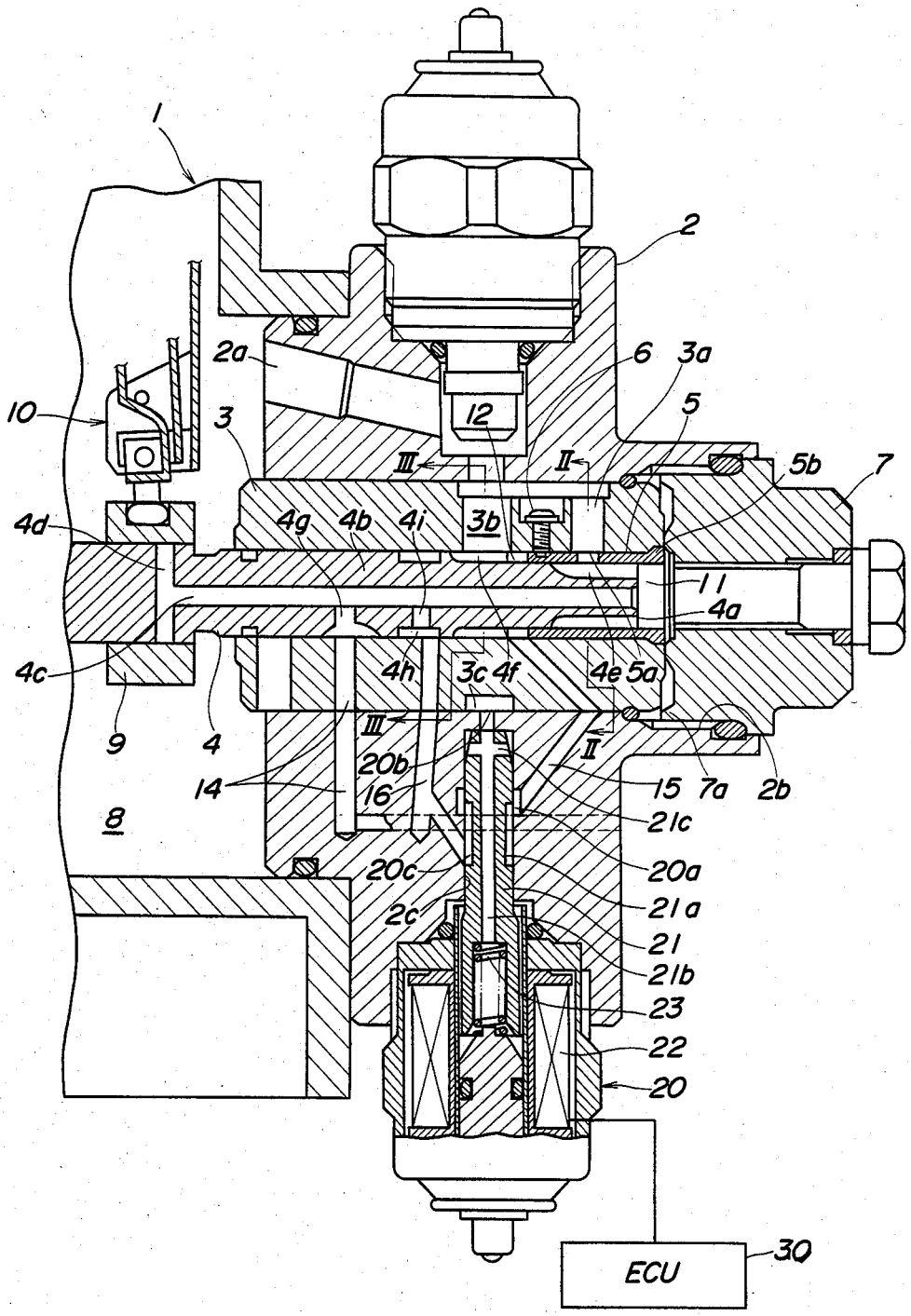
FIG. 1 is a longitudinal section view of essential part of a distributor type fuel injection pump equipped with an injection rate control system according to an embodiment of the invention.

Referring first to FIG. 1, there is shown essential part of a distributor-type fuel injection pump equipped with an injection rate control system according to the invention. Fitted in a pump housing 2 is a main plunger barrel 3 in which is slidably fitted a plunger 4 for pumping and distribution of fuel. This plunger 4 is connected to an internal combustion engine, not shown, by cam drive means, not shown, to be driven thereby for making a concurrent reciprocating and rotative motion for pressure delivery and distribution of fuel into cylinders of the engine. The plunger 4 has a first portion 4*a* with a smaller diameter at its head, and a second portion 4*b* with a larger diameter continuous with the first portion 4*a*. The second portion 4*b* is slidably fitted in the main plunger barrel 3, while the first portion is slidably fitted in a sub plunger barrel 5 fitted in an end portion of the main plunger barrel 3.

The sub plunger barrel 5, which is formed of a short hollow cylindrical member formed integrally with a flange 5b at its end, is inserted into the main plunger barrel 3 through an open end thereof, and its flange 5b is fitted in an annular stepped shoulder formed along the perimeter of the open end of the main plunger barrel 3. This sub plunger barrel 5 is retained in the main plunger barrel 3 by a screw member 6 in a manner prohibited from circumferential and axial movement relative to the main plunger barrel 3. A plug 7 is threadedly fitted in an opening 2b of the pump housing 2 in alignment with the main plunger barrel 3, with an annular protuberance 7a on an inner end face thereof in urging contact with an opposed end face of the main plunger barrel 3.

The plunger 3 has a portion located within a suction space 8 defined within the pump housing 2, on which portion is axially slidably fitted a control sleeve 9 which is operatively connected with a tension lever 10 in engagement with a control lever and a governor mechanism, neither of which is shown, so that the axial position of the control sleeve 9 on the plunger 4 is controlled by the control lever and the governor mechanism through the tension lever 10, which determines the timing of communication of a cut-off port 4d formed in the plunger 4 in communication with an axial passage 4c extending along the axis of the plunger 4 during delivery stroke of the plunger, that is, the timing of fuel injection end.

The main plunger barrel 3 is formed with two suction ports 3a, 3b at predetermined axial locations, which communicate with the suction space 8 by way of a fuel supply passage 2a formed in the pump housing 2. The sub plunger barrel 5 is formed with a suction port 5a communicating with the suction port 3a of the main plunger barrel 3. The first smaller-diameter portion 4a and the second larger-diameter portion 4b of the plunger 4 are formed, respectively, with suction slits 4e and 4f, each corresponding in number to the number of the cylinders of the engine and circumferentially arranged at equal intervals. These suction slits 4e, 4f are disposed to be successively communicated with the respective suction ports 5a, 3b as the plunger 4 rotates. A first pump working chamber 11 is defined between an end face of the first portion 4a of the plunger 4 and an opposed end face of the plug 7, and a second pump working chamber 12 is defined between an end face of the stepped shoulder or boundary between the first and second portions 4a, 4b and an opposed end face of the sub plunger barrel 5. These pump working chambers 11, 12 are communicated with the respective suction ports 5a, 3b by way of the respective suction slits 4e, 4f of the plunger 4.

A plurality of fuel delivery passages 14 are formed in the main plunger barrel 3 and the pump housing 2, opening in the inner peripheral surface of the plunger barrel 3 at circumferentially equal intervals for registering with a distribution port 4g communicating with the axial passage 4c of the plunger 4. Thus, as the plunger 4 rotates, the first pump working chamber 11 is communicated successively with the fuel delivery passages 14 through the distribution port 4g and the axial passage 4c. These fuel delivery passages 14 lead to delivery valves, not shown, connected to fuel injection valves, not shown. A communication passage 15 is formed in the main plunger barrel 3 and the pump housing 2 and communicates with the second pump working chamber 12 to connect same with a port 20a of a selector valve 20 formed of a solenoid valve (hereinafer merely called "the solenoid valve 20").

The solenoid valve 20 has a valve body 21 axially slidably fitted in a valve bore 2b formed in the pump housing 2 for movement in the radial direction of the plunger 4. The valve body 21 has its peripheral surface formed with an annular groove 21a at a predetermined location, and also formed with an axial through bore 21b along its axis, a radial through bore 21c intersecting with the axial through hole 21b at a tapered tip thereof. A communication port 20b is formed in the pump housing 2 communicating the valve bore 2b with an annular groove 3c formed in the outer peripheral surface of the main plunger barrel 3 in communication with the suction port 3b. The annular groove 3c forms in cooperation with the port 20b, suction port 3b, fuel supply passage 2a a drain passageway for pressurized fuel from the first and second pump working chambers 11, 12 to the suction space 8. The valve body 21 and the valve bore 2b define a port 20c communicating with a communication passage 16 formed in the pump housing 2 and opening into an annular groove 4h formed in the outer peripheral surface of the enlarged first portion 4b of the plunger 4, the annular groove 4h in turn communicating with the axial passage 4c in the plunger 4 via a communication bore 4i.

The solenoid valve 20 is constructed such that when the solenoid 22 is deenergized, the valve body 21 is urgedly biased by the force of a spring 23 to assume a closed position as illustrated, wherein the port 20c or the passage 16 and the port 20b are communicated with each other, whereas when the solenoid 22 is energized, the valve body 21 is urgedly displaced downward as viewed in FIG. 1 against the force of the spring 23 to assume an open position wherein the the ports 20b, 20c are disconnected from each other. Thus, with the solenoid valve 20 closed, the second pump working chamber 12 is communicated with the axial passage 4c of the plunger 4 so that the pressurized fuel in the second pump working chamber 12 is pressure delivered together with the pressurized fuel in the first pump working chamber 11 to the fuel injection valves to be injected into the engine cylinders, whereas with the solenoid valve 20 open, the second pump working chamber 12 is communicated with the suction port 3b, that is, the suction space 8 so that the pressurized fuel in the second pump working chamber 12 is returned to the suction space 8. Thus, when the solenoid valve 20 is closed, the second pump working chamber 12 takes part in the fuel injection together with the first pump working chamber 11, while when the solenoid valve 20 is open, it does not take part in the fuel injection.

Figure 2A:
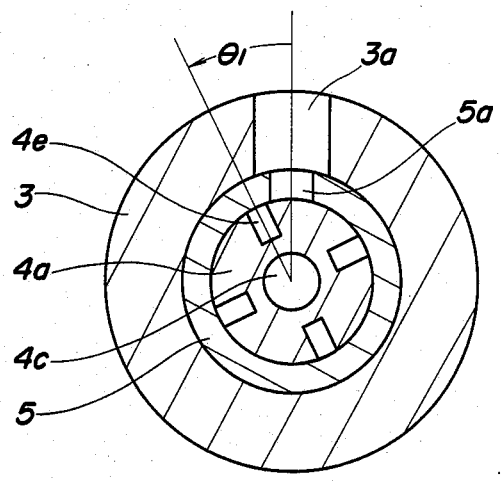
FIG. 2 (*a*) is a transverse cross-sectional view taken along line II—II in FIG. 1.
Figure 2B:
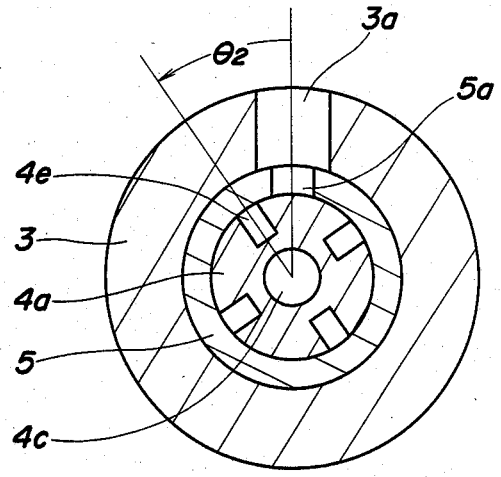
Figure 3A:
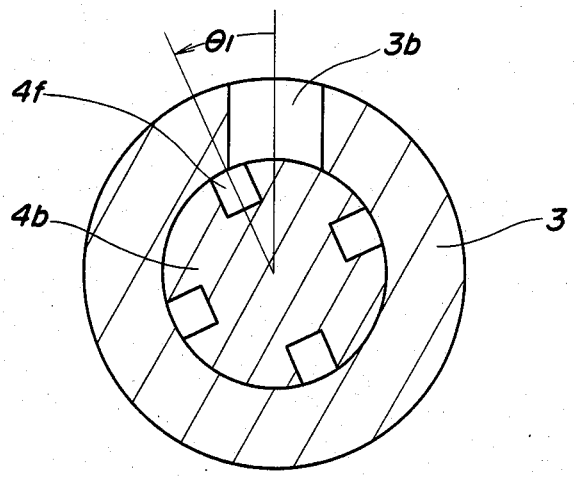
FIG. 3 (*a*) is a transverse cross-sectional view taken along line III—III in FIG. 1.
Figure 3B:
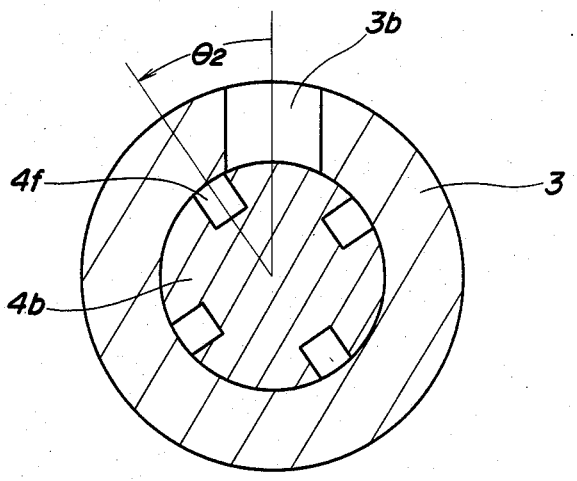

As shown in FIG. 2 (*a*) and FIG. 3 (*a*), the suction slits 4f of the enlarged or second portion 4b of the plunger 4 have a width larger than that of the suction slits 4e of the smaller-diameter or first portion 4a. Also, the diameter or bore of the suction port 3b is larger than that of the suction port 5a of the sub plunger barrel 5. The widths of the suction slits 4e, 4f and the diameters of the suction ports 5a, 3b are set as follows: When the plunger 4 has rotated through a predetermined rotational angle (=cam angle) $\theta_1$, one of the suction slits 4e of the smaller portion 4a becomes disconnected from by the suction port 5a of the sub plunger barrel 5, as shown in FIG. 2 (*a*). However, at this instant a corresponding one of the suction slits 4f of the second portion 4b is still communicated with the suction port 3b of the main plunger barrel 3, as shown in FIG. 3 (*a*). Then, when the plunger 4 has rotated through a predetermined rotational angle $\theta_2$ larger than $\theta_1$, the corresponding suction slit 4f becomes disconnected from the suction port 3b, as shown in FIG. 3 (*b*).

With this setting of the suction slits and suction ports, when the solenoid valve 20 is closed as shown in FIG. 1, the first and second pump working chambers 11, 12 are both continually communicated with the suction space 8 through passage 16, ports 20c, 20a, communication passage 15, second pump working chamber 12, suction slit 4f, suction port 3b, and fuel supply passage 2a, until the second pump working chamber 12 becomes closed, that is, until the plunger 4 has rotated through the predetermined rotational angle $\theta_2$ whereby a suction slit 4f of the enlarged portion 4b of the plunger 4 is disconnected from the suction port 3b of the main plunger barrel 3. On the other hand, when the solenoid valve 20 is open, the second pump working chamber 12 alone is always communicated as long as the valve 20 is open. However, on this occasion, the first pump working chamber 11 is not communicated with the suction space 8 until the plunger 4 has rotated through the predetermined rotational angle $\theta_1$. Thus, the delivery stroke executed by the plunger 4 when the solenoid valve 20 is open is longer than that executed when the valve 20 is closed, by an amount corresponding to $\Delta\theta=\theta_1-\theta_2$.

Therefore, at a predetermined setting location of the control sleeve 9, e.g. when the engine rotational speed assumes a predetermined value slightly higher than the idling rpm, the delivery fuel quantity and accordingly the fuel injection quantity will be substantially equal between when the first and second pump working chambers 11, 12 are used at the same time by closing the solenoid valve 20 and when the first pump working chamber 11 alone is used by opening the solenoid valve 20. This will be well understood from the following equation:

$$\frac{\pi}{4} d^2 \times S_2 = \frac{\pi}{4} D^2 \times S_1 = Q \quad (1)$$

where d=diameter of the portion 4a of the plunger 4;

D=diameter of the portion 4b of same (>d);

$S_2$=delivery stroke of the plunger 4 executed when the solenoid valve 20 is open; and $S_1$=delivery stroke of the plunger 4 when the solenoid valve 20 is closed ($<S_2$).

Therefore, by setting the values of $S_1$, $S_2$ so as to satisfy the above equation (1), the delivery fuel quantity Q can be made equal between the time of closing of the solenoid valve 20 and the time of opening of same. As stated before, the delivery stroke $S_2$ of the plunger 4 can be set by selecting the width of the suction slits 4f of the second portion 4b of the plunger 4 and/or the diameter of the suction port 3b of the main plunger barrel 3 so as to satisfy the equation (1).

The solenoid valve 20 is controlled to selectively close and open by means of an electronic control unit 30 appearing in FIG. 1, which is responsive to input parameter signals indicative of operating conditions of the engine, e.g. engine rotational speed, engine load, engine cooling water temperature, throttle valve opening, and vehicle speed, to determine operating conditions of the engine in which the engine is operating, on the basis of these parameter signals, energize the solenoid 22 of the solenoid valve 20 to open same to use only the first pump working chamber 11 to reduce the injection rate when the engine is operating in a low speed/low load condition such as idling, and deenergize the solenoid 22 to close same to use both the first and second pump working chambers 11, 12 to increase the injection rate when the engine is operating in a condition other than the above low speed/low load condition, e. g. in a high speed/high load condition.

The operation of the injection rate control system will now be described with reference to FIGS. 3 and 4, as well as FIGS. 1 and 2. When the engine is operating in a high speed/high load condition, for instance, the solenoid valve 20 is closed, the two pump working chambers 11, 12 are both made to take part in the fuel delivery action, as stated before. When the plunger 4 is leftwardly moving through its suction stroke as viewed in FIG. 1, fuel in the suction space 8 is sucked into the first and second pump working chambers 11, 12 through the respective suction ports 5a, 3b, and respective suction slits 4e, 4f [Solid line I in FIG. 4 (*a*)]. Then, when the plunger 4 is rightwardly moving through its delivery stroke as viewed in FIG. 1, and it has rotated through the predetermined rotational angle $\theta_1$ as shown in FIG. 2 (*a*), the fuel within the first pump working chamber 11 starts to be pressurized and pressure delivered [Solid line II in FIG. 4 (*a*)].

Figures 4A, 4B, 4C:
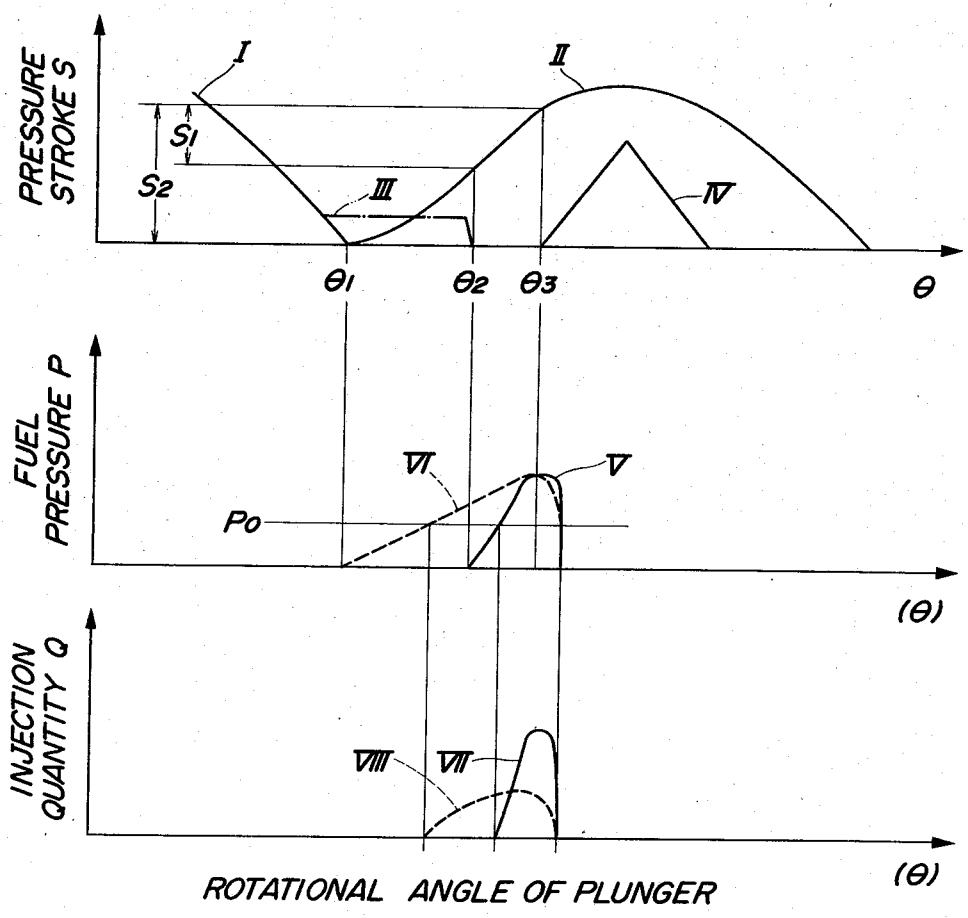
FIG. 4 (*a*) is a graph showing the relationship between the delivery stroke of the plunger and the rotational angle of same.

However, at this instant when the predetermined rotational angle $\theta_1$ has been executed by the plunger 4, the suction slit 4f and the suction port 3b are still communicated with each other to communicate between the second pump working chamber 12 with the suction space 8 [FIG. 2 (*a*) and the chain line III in FIG. 4 (*a*)]. Consequently, the fuel pressure delivered from the first pump working chamber 11 is returned to the suction space 8 and not delivered to the fuel injection valve. When the plunger 4 has then finished rotating through the predetermined rotational angle $\theta_2$ ($>\theta_1$), the suction slit 4f becomes disconnected from the suction port 3b as shown in FIG. 3 (*b*), whereby the pressurized fuel starts to be delivered to the fuel injection valve from the two pump working chambers 11, 12. Thereafter, the pressure P of the pressurized fuel being delivered to the fuel injection valve rises along the solid line V for instance, as shown in FIG. 4 (*b*). When the fuel pressure P exceeds the valve opening pressure Po of the fuel injection valve, the fuel injection is started as shown in FIG. 4 (*c*).

When the cut-off port 4d of the plunger 4 becomes disengaged from an end of the control sleeve 9 and communicated with the suction space 8 at a rotational angle $\theta_3$ during delivery stroke of the plunger 4 [FIG. 4 (*a*)], the pressurized fuel is returned from the first and second pump working chambers 11, 12 to the suction space 8, to terminate the fuel injection [FIG. 4 (*c*)]. In FIG. 3 (*a*), the solid line IV represents the moving range of the control sleeve 9. In this way, while the plunger 4 is moving from $\theta_2$ to $\theta_3$, i.e. through the delivery stroke $S_1$, fuel is delivered to the fuel injection valve from which fuel is injected into the corresponding cylinder along the solid line VII in FIG. 4 (*c*).

Now, when the engine is operating in a low load/low speed region. e.g. in an idling region, the solenoid valve 20 has its solenoid 22 energized to open by the electronic control unit 30, whereby the second pump working chamber 12 is communicated with the suction space while the first pump working chamber 11 is disconnected from the second pump working chamber 12. When the plunger has executed its delivery stroke through the predetermined rotational angle $\theta_1$ [FIG. 2

(*a*) and the solid line II in FIG. 4 (*a*)], pressure delivery of fuel is started. The pressure P of the fuel pressure being pressure delivered to the fuel injection valve rises along the broken line VI in FIG. 4 (*b*). When the pressure P exceeds the valve opening pressure Po of the fuel injection valve, the valve is opened as indicated by the broken line VIII in FIG. 4 (*c*), to start the fuel injection.

When the plunger 4 has executed its delivery stroke through the rotational angle $\theta_3$ as indicated in FIG. 4 (*a*), the cut-off port 4*d* becomes disengaged from the end of the control sleeve 9 and opens into the suction space 8, and then the pressurized fuel is returned from the pump working chamber 11 to the suction space 8, terminating the fuel injection from the fuel injection valve [Broken line VIII in FIG. 4 (*c*)]. In this way, while the plunger 4 is moving from $\theta_1$ to $\theta_3$, i.e. through the delivery stroke $S_2$ ($>S_1$), fuel is pressure delivered to the fuel injection valve.

The above delivery strokes $S_1$, $S_2$ to be executed by the pluner 4 are set at such values as to satisfy the equation (1), and accordingly the total fuel quantity indicated by the solid line VII in FIG. 4 (*c*) is equal to that indicated by the broken line VIII in the same figure. Thus, there will be no drop in the fuel quantity supplied to the fuel injection valves when the solenoid valve 20 is opened from its closed state. In other words, according to the invention, when the solenoid valve 20 is shifted from the closed position to the open position with the control sleeve 9 set in the aforementioned predetermined position, the delivery stroke of the plunger 4 is increased from $S_1$ to $S_2$ ($>S_1$), to maintain the fuel injection quantity at a value obtained immediately before the shifting of the solenoid valve 20.

Although in the present embodiment both of the suction slits 4*f* of the enlarged second portion 4*b* of the plunger 4 and the suction port 3*b* of the main plunger barrel 3 are set in width or diameter at larger values than those of the suction slits 4*e* of the smaller-diameter portion 4*a* of the plunger and the suction port 5*a* of the sub plunger barrel 5, respectively, to set the delivery stroke $S_1$ at a value larger than $S_2$, this is not limitative. Alternatively, only either the width of suction slits 4*f* or the diameter of the suction port 3*b* may be set at a larger value.

Obviously many modifications and variations of the present invention are possible in the light of the above disclosure. It is therefore to be understood that within the scope of the appended claims the invention may be practiced otherwise than as specifically described.

What is claimed is:

1. In a distributor-type fuel injection pump for an internal combustion engine having a plurality of cylinders and a plurality of fuel injection valves for injecting fuel into respective ones of said cylinders, said fuel injection pump including a plunger arranged for concurrent reciprocating and rotative motion in response to rotation of said engine to perform pressure delivery and distribution of fuel into said cylinders of said engine, said plunger having a first portion and a second portion having different diameters from each other, a first pump working chamber defined by said first portion, a second pump working chamber defined by said second portion, a plurality of fuel delivery passageways arranged for communication with said first pump working chamber and leading to respective ones of said fuel injection valves of said engine, a communication passageway arranged for communicating said second pump working chamber with said fuel delivery passageways, a drain passageway arranged for communicating said communication passageway with a zone under a lower pressure of said pump, a control sleeve displaceable relative to said plunger for determining the timing of fuel injection end, a selector valve arranged to selectively close and open said drain passageway, and control means responsive to operating conditions of said engine for driving said selector valve to selectively assume a closed position and an open position in which said drain passageway is closed and opened, respectively, whereby fuel is pressure delivered to said fuel injection valves from one or both of said first and second pump working chambers, depending upon whether said selector valve assumes said closed position or said open position, the improvement comprising means for increasing a delivery stroke to be executed by said plunger, when said control sleeve assumes a predetermined position relative to said plunger and at the same time said selector valve is controlled by said control means to assume a predetermined one of said closed position and said open position.

2. A distributor-type fuel injection pump as claimed in claim 1, wherein said predetermined position of said control sleeve corresponds to a predetermined low speed/low load region of said engine.

3. A distributor-type fuel injection pump as claimed in claim 1, wherein said means for increasing the delivery stroke of said plunger is adapted to increase the delivery stroke when said selector valve assumes said open position.

4. A distributor-type fuel injection pump as claimed in claim 3, wherein said means for increasing the delivery stroke of said plunger comprises a first suction port, a plurality of first suction slits formed in said plunger in communication with said first pump working chamber and disposed for communication with said first suction port, pressure delivery of fuel from said first pump working chamber being initiated when each of said first suction slits is disconnected from said first suction port during rotation of said plunger, a second suction port, and a plurality of second suction slits formed in said second portion of said plunger in communication with said second pump working chamber and disposed for communication with said second suction port, pressure delivery of fuel from said second pump working chamber being initiated when each of said second suction slits is disconnected from said second suction port during rotation of said plunger, said second suction port and said suction slits being designed relative to said first suction port and said first suction slits such that the timing of disconnection of each of said second suction slits from said second suction port is earlier by a predetermined period of time than that of a corresponding one of said first suction slits from said first suction port as said plunger rotates.

5. A distributor-type fuel injection pump as claimed in claim 4, wherein said second suction port has a larger diameter than that of said first suction port and said second suction slits have a larger width than that of said first suction slits such that the timing of disconnection of each of said second suction slits from said second suction port is earlier by a predetermined period of time than that of a corresponding one of said first suction slits from said first suction port as said plunger rotates.

* * * * *